US008257556B2

(12) United States Patent
Ogiwara

(10) Patent No.: US 8,257,556 B2
(45) Date of Patent: Sep. 4, 2012

(54) FELT FOR PAPERMAKING

(75) Inventor: Yasuyuki Ogiwara, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 355 days.

(21) Appl. No.: 12/678,199

(22) PCT Filed: Aug. 12, 2008

(86) PCT No.: PCT/JP2008/064681

§ 371 (c)(1),
(2), (4) Date: Mar. 15, 2010

(87) PCT Pub. No.: WO2009/037934

PCT Pub. Date: Mar. 26, 2009

(65) Prior Publication Data

US 2010/0200188 A1 Aug. 12, 2010

(30) Foreign Application Priority Data

Sep. 18, 2007 (JP) ..... 2007-240909

(51) Int. Cl.
*D21F 7/08* (2006.01)

(52) U.S. Cl. ..... 162/358.2; 162/900; 442/189; 442/270

(58) Field of Classification Search ..... 162/358.2, 162/900, 348, 358.1, 901–904; 442/270, 442/189; 139/383 A, 383 AA, 425 A
See application file for complete search history.

(56) References Cited

U.S. PATENT DOCUMENTS

| | | | | |
|---|---|---|---|---|
| 5,194,121 | A * | 3/1993 | Taguchi et al. | 162/358.1 |
| 7,138,037 | B2 * | 11/2006 | Despault et al. | 162/358.2 |
| 2005/0167069 | A1 * | 8/2005 | Kobayashi et al. | 162/358.2 |

FOREIGN PATENT DOCUMENTS

| | | |
|---|---|---|
| JP | 280183/1994 | 10/1994 |
| JP | 13385/2003 | 1/2003 |

* cited by examiner

*Primary Examiner* — Eric Hug
(74) *Attorney, Agent, or Firm* — Howson & Howson LLP

(57) ABSTRACT

The present invention provides a papermaking felt which exhibits a good dewatering capability (water permeability) and resistance to flattening in a papermaking machine, and which is capable of improving surface smoothness of a wet paper web and has improved anti-dehairing property.
A papermaking felt using a woven fabric in which at least one of an MD yarn and a CMD yarn arranged on a wet paper web side of a base body is a multifilament yarn which is a bundle of a plurality of filaments with fineness of 100 dtex or less and which is substantially without twisting or only loosely twisted and hence almost without twisting.

5 Claims, 3 Drawing Sheets

FELT FOR PAPERMAKING

FIELD OF INVENTION

The present invention relates to a papermaking felt (hereinafter also referred to as a "felt"). More specifically, it relates to a papermaking felt which is pressurized in a press section of a papermaking machine to dewater a wet paper web sheet.

BACKGROUND ART

It is an object of the present invention to provide a papermaking felt which is not only effective to dewater a wet paper web and to smooth the surface thereof but also shows an improved anti-dehairing property of a staple fiber web, and more specifically a papermaking felt which is capable of improving surface smoothness of a wet paper web and usable especially in a high-speed papermaking machine.

A papermaking process with a papermaking machine consists of three main parts, namely, forming, press, and drying sections, through which a wet paper web is dewatered successively. Papermaking equipments with a dewatering function are employed in each section, which is a papermaking felt in the press section.

Conventionally, a papermaking felt has had functions to dewater a wet paper web (dewatering capability), improve smoothness of a wet paper web (smoothness), and transfer a wet paper web (a capability to transfer a wet paper web). A papermaking felt is required to have a balanced combination of these basic functions.

Water within a wet paper web is either discharged from the underside of the felt after moving into the felt due to pressure as the wet paper web passes between a pair of press rolls, or discharged outside of the felt after vacuumed up in a suction box of a papermaking machine. Accordingly, important functions required for the felt are water permeability and a capability for a compressed felt to rebound without flattening when depressurized. It is also important for such functions to endure use.

Mainstream types of a typical papermaking felt are batt-on-base or batt-on-mesh types in which a staple fiber web is implanted into a woven fabric by means of needle punching. Recently, the batt-on-mesh type is favorably used in a high-speed papermaking machine, which leads to an increasing attention to surface smoothness of a wet paper web and anti-dehairing property of a staple fiber web.

Referring to FIG. 1, a structure of a typical felt is to be described. A papermaking felt 10 is an endless belt, and comprises a base body 20 made of a woven fabric or others and a staple fiber web (staple fiber) layer 30 which is intertwiningly integrated with the base body 20 by needle punching. The base body 20 is to provide the felt 10 with mechanical strength, which is a woven fabric made of a machine direction (MD) yarn 50 and a cross machine direction (CMD) yarn 40 in FIG. 1.

As already mentioned, the felt 10 is used in a press section of a papermaking machine (not shown in the figure), tensioned by guide rolls. It dewaters a wet paper web, as subjected to high pressure together with the paper web in the press section composed of a pair of press rolls or a press roll and a shoe. The felt 10 drives with the rotation of the press rolls.

DISCLOSURE OF INVENTION

Felts are used in increasingly harsh conditions because of speeding up of papermaking machine operation for raising productivity, or increasing pressure of the roll press or the shoe press in the press section. As a result, there has been a problem that the dewatering capability has been seriously impaired due to flattening of the papermaking felt under high pressure and associated degrading of water permeability and resistance to flattening.

Additionally, an increase of dehairing of the staple fiber web due to speeding-up of a papermaking machine has been raising concern about its effect on the quality of finished paper.

Thus, there is a demand for even higher level of above-mentioned functions required for a felt, namely, a sustained dewatering capability due to water permeability and resistance to flattening, and anti-dehairing property of a staple fiber web.

Various proposals have been made to solve the problem. One example is a proposal to prevent flattening of a felt by raising the proportion of a base body part. Unexamined Japanese Patent Publications No. 13385/2003 and No. 280183/1994 disclose examples of methods to increase the proportion of the base body part, which is to overlap endless hollow weave base fabrics or base fabrics made endless by joining both ends of base bodies, on which a staple fiber web is layered, which are then intertwiningly integrated by needling.

On the other hand, as used in a papermaking machine, a felt structure gradually loses thickness due to repetitive compression and restoration. As is generally known, a staple fiber web layer in the felt structure is made flattened and prone to dehairing. This is because the staple fiber web which is finer than the base body in the felt structure is worn down or cut off due to effects of repetitive compression and rubbing. In a typical felt, the staple fiber web is 1-50 dtex, preferably 3-30 dtex. A felt made of thicker staple fibers or with a thinner staple fiber layer has better anti-flattening and anti-dehairing property, but impairs surface smoothness of a wet paper web.

Patent publication 1 discloses an example of conventional techniques to improve surface smoothness of a wet paper web. It is a felt structure wherein a nonwoven fabric, in which yarns are arranged approximately parallel to each other only in the lateral direction, is inserted in-between two or more layered woven fabrics. The inserted nonwoven fabric has an effect to prevent knuckles of the woven fabric (ups and downs made by an MD yarn and a CMD yarn) and the MD yarn from impairing surface smoothness of a wet paper web. Such a structure employing a nonwoven fabric, however, increases a basis weight of a felt, thereby degrading the dewatering capability and handleability.

Further, there has been a proposal to use a multi-strand yarn to improve the dewatering capability. According to Unexamined Japanese Patent Publication No. 260378/1996, for example, a woven fabric in a papermaking felt includes filaments which are made of twisted multi-strand yarns and which have a diameter of 0.04-0.18 mm, and has improved water permeability. However, the filament is made rigid due to twisting, and therefore the felt had a problem in terms of surface smoothness of a wet paper web.

The present invention aims to provide a papermaking felt which overcomes the problems above, exhibits a good dewatering capability (water permeability) and resistance to flattening in a papermaking machine, and which has improved capability to smooth a wet paper web surface and anti-dehairing property.

After studying structures to accomplish the goal, inventors of this invention discovered that the objectives can be achieved by using a base body in which at least one of an MD yarn and a CMD yarn arranged on a wet paper web side of the base body is a multifilament yarn which is a bundle of a plurality of filaments with fineness of 100 dtex or less and which is substantially without twisting or only loosely twisted.

Means for Solving the Problem

The present invention provides a papermaking felt wherein a staple fiber web is layered on one side or both sides of a base body, which are intertwiningly integrated together by needling, characterized in that at least one of an MD yarn and a CMD yarn arranged on a wet paper web side of the base body is a multifilament yarn which is a bundle of a plurality of filaments with fineness of 100 dtex or less and which is substantially without twisting.

In this invention, the multifilament yarn can be a loosely twisted yarn with twisting of preferably 1-50 times per 1 m, and more preferably 1-30 times per 1 m.

Further, in the present invention, the base body can be two or more woven fabrics of the same or different types, or a triple weave fabric.

Since at least one of the MD yarn and the CMD yarn arranged on the wet paper web side of the base body is a multifilament yarn which is a bundle of a plurality of filaments with fineness of 100 dtex or less and which is substantially without twisting, knuckles of the CMD yarn projected on the wet paper web side of the woven fabric are flattened. Accordingly, the present invention is capable of achieving the objectives above, even with a thinner staple fiber web layer.

Moreover, compared to a relatively thick filament (of, for example, 100 dtex or more), the multifilament yarn of this invention is finer and substantially without twisting. Therefore, it easily entangles with the staple fiber web, thereby improving anti-dehairing property of the staple fiber web.

Further, in the present invention, the above objectives can also be achieved by using a loosely twisted yarn for the multifilament yarn, which is twisted preferably 1-50 times per 1 m, and more preferably 1-30 times per 1 m. A yarn twisted more than 50 times impairs surface smoothness of a wet paper web because of its rigidity.

This invention successfully accomplishes the goal above with the effect of flattening of a yarn realized by using a multifilament yarn which is a bundle of a plurality of filaments with specific fineness (100 dtex or less) and which is substantially without twisting or almost without twisting with 1-50 times of loose twisting.

Thus, since at least one of the MD yarn and the CMD yarn arranged on the wet paper web side of the base body is a multifilament yarn which is a bundle of a plurality of filaments with fineness of 100 dtex or less and which is substantially without twisting or only loosely twisted and hence almost without twisting, the present invention smoothes ups and downs (unevenness) of yarns in knuckles of the woven fabric and therefore improves surface smoothness of a wet paper web.

In this invention, a multifilament which is substantially without twisting or only loosely twisted and hence almost without twisting means a multifilament yarn in a state absent of a force to untwine (rotary torque), and is defined as a multifilament yarn twisted preferably 1-50 times per 1 m, and more preferably 1-30 times per 1 m.

The base body of the present invention comprises layered two or more woven fabrics of the same of different types, and in the woven fabric arranged on the wet paper web side, at least one of the MD yarn and the CMD yarn arranged on the wet paper web side of the base body can be a multifilament yarn which is a bundle of a plurality of filaments with fineness of 100 dtex or less and which is substantially without twisting or only loosely twisted and hence almost without twisting.

Preferably, the layered fabrics are composed of an upper single weave fabric and a lower fabric of a single weave or a more complex texture. In such a composition, the lower fabric provides the felt with mechanical strength and the upper fabric provides with a capability to improve surface smoothness of a wet paper web and anti-dehairing property of the staple fiber web.

In another embodiment of this invention, the base body is made of a triple weave fabric, wherein at least one of the MD yarn and the CMD yarn arranged on the wet paper web side thereof can be a multifilament yarn which is a bundle of a plurality of filaments with fineness of 100 dtex or less and which is substantially without twisting or only loosely twisted and hence almost without twisting. Preferably, the base body is made of a warp backed triple weave fabric, wherein the MD yarn (upper layer) arranged on the wet paper web side thereof is a multifilament yarn which is a bundle of a plurality of filaments with fineness of 100 dtex or less and which is substantially without twisting or only loosely twisted and hence almost without twisting. Yarns other than the multifilament yarn of this invention, such as a monofilament single yarn or a monofilament twist yarn, can be used for other MD yarns composing the warp backed triple weave fabric. In this case, other MD yarns provide the felt with mechanical strength and the yarns of the upper layer provides with a capability to improve surface smoothness of a wet paper web and anti-dehairing property of the staple fiber web.

Materials for the multifilament yarn of the present invention include polyamide, aromatic polyamide, polyolefin, acrylic, polyester, in which polyamide is a preferable one for its superior strength and durability.

Since the multifilament yarn of this invention is without twisting or almost without twisting with loose twisting, it may sometimes get untwined when weaving. To deal with this problem, the filament can be made bulky or temporarily fixed by being coated and impregnated with a hydrosoluble binder. The binder is preferably the one which can be easily removed by water when the felt of this invention is used in a papermaking machine.

Advantages of the Invention

A felt of the present invention has improved capability to smooth a wet paper web surface, because a multifilament yarn which is arranged on a wet paper web side of a woven fabric composing a base body and which is substantially without twisting or only loosely twisted and hence almost without twisting smoothes ups and downs (undulations) of yarns in knuckles of the woven fabric. Further, since the multifilament yarn of the present invention can be easily entangled with a staple fiber web, it improves anti-dehairing property of the staple fiber web.

PREFERRED EMBODIMENT OF THE INVENTION

Figure 1:
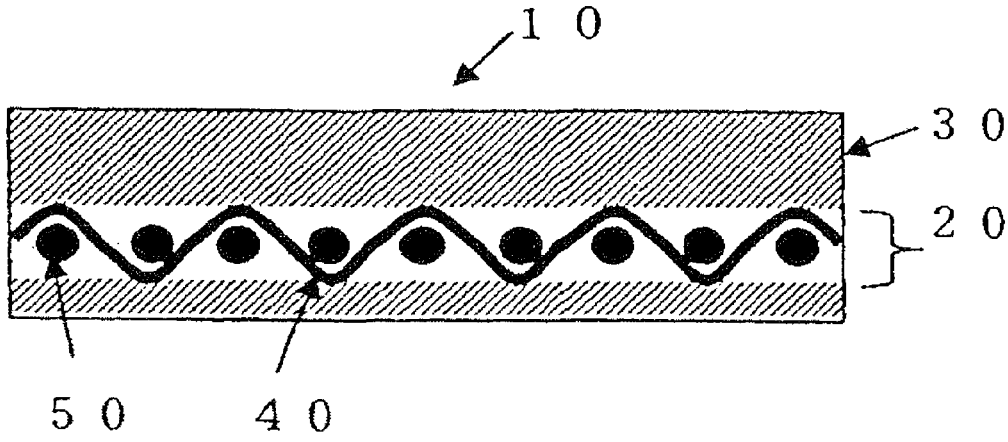
FIG. 1 is a sectional view of a conventional and typical papermaking felt.
Figure 2:
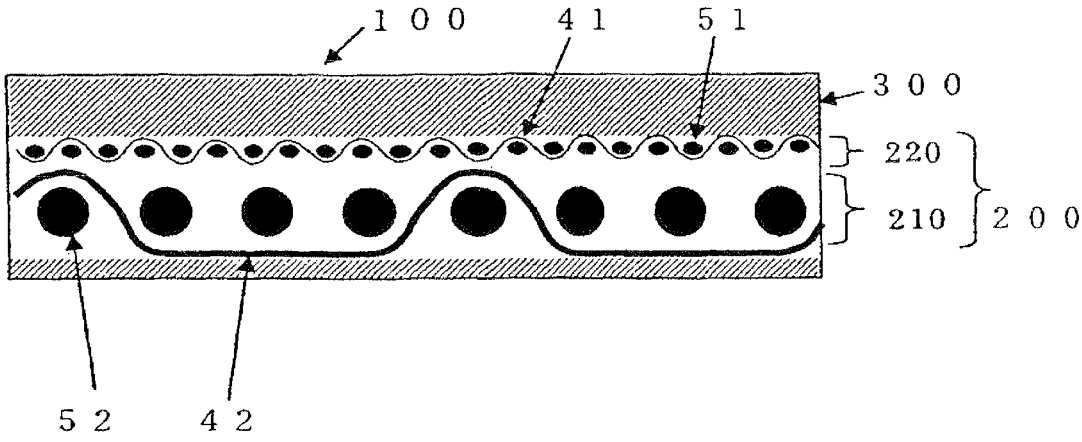
FIG. 2 is a sectional view illustrating an embodiment of the present invention.

Referring to FIG. 2, an example of embodiments of the present invention is to be described. A papermaking felt of this invention 100 comprises a base body 200 and a staple fiber web layer 300. A staple fiber web (staple fiber) is intertwiningly integrated with the base body 200 by needle punching to form the staple fiber web layer 300.

The base body 200 comprises two base bodies, a base body A (210) and a base body B (220). Various materials can be used for the base body A (210) without limitation, with the only requirement to provide the felt 100 with mechanical strength and to have sufficient strength. One example is a fabric woven with an MD yarn 52 and a CMD yarn 42. Although FIG. 2 shows layered base body A (210) and base body B (220) of different kinds, they can be of the same kind, as long as the base body B (220) can meet the requirement of the present invention.

The base body A (210) can be the one made by weaving a fabric with the MD yarn 52 and the CMD yarn 42, which has smaller width than a felt to be produced, which is then spiraled and joined together on adjacent ends. It can also be the one made by coaxially winding a fabric woven with the MD yarn 52 and the CMD yarn 42, which has approximately the same width as a finished felt. Further, it needs not be a woven fabric, and can be a base body made by fixing the MD yarn 52 with an adhesive, or simply overlapping the MD yarn 52 and the CMD yarn 42 without weaving.

In the present invention, the base body 200 is composed of the base body A (210) and the base body B (220) layered thereon. The base body B (220) is made of a woven fabric in which at least one of an MD yarn 51 and a CMD yarn 41 is a multifilament yarn which is a bundle of a plurality of filaments with fineness of 100 dtex or less and which is substantially without twisting or only loosely twisted and hence almost without twisting, a feature of this invention.

Figure 3:
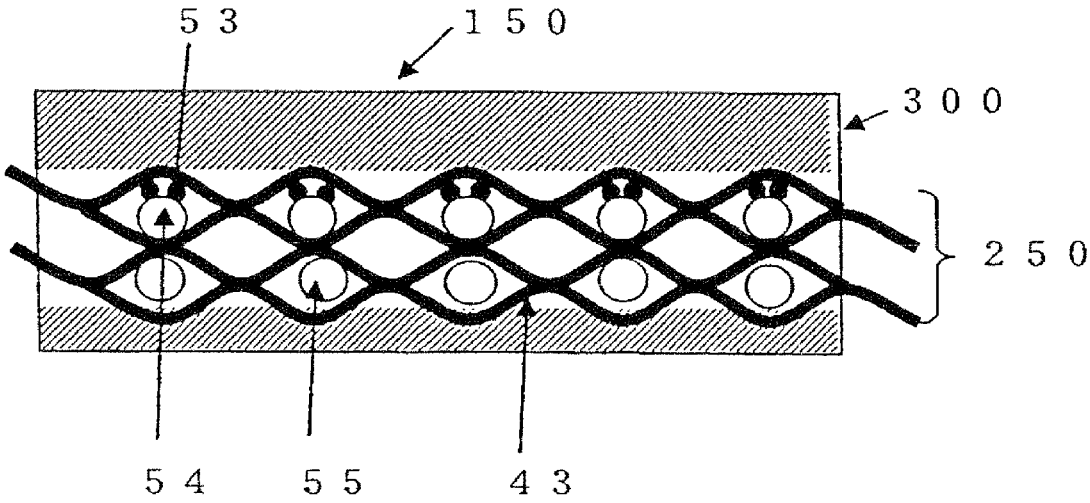
FIG. 3 is a sectional view illustrating another embodiment of the present invention.

FIG. 3 illustrates another embodiment of the present invention. A papermaking felt 150 of this invention comprises a base body 250 and a staple fiber web layer 300. A staple fiber web (staple fiber) is intertwiningly integrated with the base body 250 by needle punching to form the staple fiber web layer 300.

The base body 250 is made of a triple weave fabric, wherein an MD yarn 53 (upper layer) is a multifilament yarn which is a bundle of a plurality of filaments with fineness of 100 dtex or less and which is substantially without twisting or only loosely twisted and hence almost without twisting. Other MD yarns 54, 55 can be yarns other than the multifilament yarn of this invention, such as a monofilament single yarn or a monofilament twist yarn. In this case, there is no limitation for the material or fineness of other MD yarns 54, 55, with the only requirement to provide the felt with MD mechanical strength. Likewise, there is no limitation for the material or fineness of a CMD yarn 43 which forms a triple weave fabric together with the MD yarn, with the only requirement to provide the felt with CMD mechanical strength.

EXAMPLES

The present invention is to be described with specific examples. In Examples 1-5 and Comparative Example 1, the base body 200 is composed of the base body A (210) and the base body B (220) layered thereon, wherein the base body A (210) has the structure below.

Structure of the Base Body A (210):

(1) MD yarn 52 and CMD yarn 42

A twist yarn below was used for both the MD yarn 52 and the CMD yarn 42.

(2) Twisting conditions: [2/2/330]

(which means [a number of yarns bundled for the second twisting which underwent the first twisting/a number of single yarns bundled for the first twisting/fineness of the single yarn=dtex]

(3) First twisting: 250 times/m in S direction (4) Second twisting: 160 times/m in Z direction (5) Texture:

A 3/1 hollow and single weave fabric was woven with the MD yarn 52: 60 yarns/5 cm and the CMD yarn 42: 40 yarns/5 cm.

Example 1

As illustrated in FIG. 2, the felt 100 is composed of the staple fiber web layer 300 which is layered on the base body 200 in which the base body B (220) below is layered on the base body A (210). The staple fiber web layer 300 is placed on both sides of the base body 200, which are intertwiningly integrated together by needle punching, wherein a basis weight is 300 g/m$^2$ on the wet paper web side and 100 g/m$^2$ on the machine side.

Structure of the Base Body B (220):

(1) MD yarn 51: a multifilament yarn below (a) Filament: nylon 6 with fineness of 80 dtex (b) Number of the yarn bundled: 40 yarns (c) Times of twisting: substantially without twisting (once/m in Z direction in this example)

(2) CMD yarn 41: monofilament single yarn of nylon 6 (500 dtex)

(3) Texture:

A 3/1 hollow and single weave fabric was woven with the MD yarn 51: 40 yarns/5 cm and the CMD yarn 41: 34 yarns/5 cm.

Example 2

A felt with the same structure as in Example 1 was produced, with the only difference that the base body B (220) was a hollow and single weave fabric woven with an MD yarn, a monofilament single yarn of nylon 6 which is the same as the CMD yarn 41, and a CMD yarn, the multifilament yarn which is the same as the MD yarn 51.

Example 3

A felt with the same structure as in Example 1 was produced, with the only difference that the base body B (220) was a hollow and single weave fabric in which a CMD yarn is the multifilament yarn, the same one used for the MD yarn 51.

Example 4

A felt with the same structure as in Example 1 was produced, with the only difference that the base body B (220) was a hollow and single weave fabric in which the MD yarn 51 is a loosely twisted multifilament yarn (30 times/m in Z direction).

Example 5

A felt with the same structure as in Example 1 was produced, with the only difference that the base body B (220) was a hollow and single weave fabric in which the MD yarn 51 is a loosely twisted multifilament yarn (50 times/m in Z direction).

Example 6

As illustrated in FIG. 3, the felt 150 is composed of the staple fiber web layer 300 layered on the base body 250. The staple fiber web layer 300 is layered on both sides of the base body 250, which are intertwiningly integrated together by needle punching, wherein a basis weight is 300 g/m$^2$ on the wet paper web side and 100 g/m$^2$ on the machine side.

Structure of the Base Body 250:

(1) MD yarn:

(a) The same multifilament yarn as the MD yarn 51 in Example 1 was used for the MD yarn 53 of the upper layer arranged on the wet paper web side.

(b) The same twist yarn as the MD yarn 52 of the base body A (210) was used for the MD yarn 54 of the middle layer.

(c) The same twist yarn as the MD yarn 54 was also used for the MD yarn 55 of the lower layer.

(2) CMD yarn 43: monofilament single yarn of nylon 6 (1000 dtex)

(3) Texture:

A 3/1 1/3 hollow weave warp backed triple fabric was woven with the MD yarn 53: 80 yarns/5 cm, the MD yarn 54, 55: 40 yarns/5 cm, the CMD yarn 43: 20 yarns/5 cm.

Example 7

A felt with the same structure as in Example 6 was produced, with the only difference that the base body 250 was a hollow weave triple fabric woven with the MD yarn 53, a monofilament single yarn of nylon 6 (1000 dtex) which is the same as the CMD yarn 43, and a CMD yarn, the multifilament yarn which is the same as the MD yarn 53 in Example 5.

Example 8

A felt with the same structure as in Example 6 was produced, with the only difference that the base body 250 was a hollow weave warp backed triple fabric in which a CMD yarn is the multifilament yarn, the same one used for the MD yarn 53 in Example 5.

Example 9

A felt with the same structure as in Example 6 was produced, with the only difference that the base body 250 was a hollow weave warp backed triple fabric in which the MD yarn 53 is a loosely twisted multifilament yarn (30 times/m in Z direction) as in Example 4.

Comparative Example 1

A felt with the same structure as in Example 1 was produced, with the only difference that the base body B (220) was a hollow and single weave fabric in which an MD yarn is the monofilament single yarn of nylon 6 (330 dtex) which is the same as the CMD yarn 43.

Comparative Example 2

A felt with the same structure as in Example 6 was produced, with the only difference that the base body 250 was a hollow weave triple fabric in which the MD yarn 53 is the same twist yarn as the MD yarn 54.

Resistance to flattening (resistance to compression fatigue), surface smoothness of a wet paper web, and anti-dehairing property of the papermaking felts produced in Examples 1-9 and Comparative Examples 1, 2 were evaluated by the following methods:

(1) Resistance to Flattening (Resistance to Compression Fatigue)

Testing samples of the papermaking felt were subjected to 200,000 times of 1500 KN/cm$^2$, 10 Hz pulse load by using a compression fatigue testing machine (a servo pulsar compression testing machine made by Shimadzu Corporation). Resistance to flattening was evaluated based on the ratio of density of the felt after testing to that of the felt prior to testing. The smaller the value, the stronger the resistance to flattening.

(2) Surface Smoothness of a Wet Paper Web

Felts' capability to smooth a wet paper web surface was evaluated by placing a pressure-sensitive film "Prescale" on (the wet paper web side of) testing samples of the papermaking felt, applying pressure of 100 KN/cm$^2$, and observing the undulations on the felt surface transferred onto the pressure-sensitive film. Here, undulations of knuckles on the wet paper web side surface of the base body were monitored.

(3) Anti-Dehairing Property

Anti-dehairing property of the papermaking felt was determined by measuring the amount of fibers fallen off from the testing samples of the papermaking felt, using a Taber abrasion tester based on JIS 1023-1992. This machine is to measure the amount of fibers dropped out of the staple fiber web of the felt, with a discoidal sample placed on a rotating turntable, on which a rotating roll with high frictional resistance is applied. In this testing, the amount of dropped fibers (mg) was measured after 5000 times of rotation of a 1 kg wheel.

Results of evaluation of Examples and Comparative Examples are shown in a table.

TABLE 1

| | Resistance to flattening | Surface smoothness of wet paper web | Anti-dehairing property (mg) |
|---|---|---|---|
| Example 1 | 1.32 | Good; no undulations of knuckles observed | 100 |
| Example 2 | 1.30 | Good; no undulations of knuckles observed | 150 |
| Example 3 | 1.35 | Good; no undulations of knuckles observed | 75 |
| Example 4 | 1.35 | Good; no undulations of knuckles observed | 130 |
| Example 5 | 1.38 | Fair; undulations of knuckles slightly observed as dots | 160 |
| Example 6 | 1.13 | Fair; undulations of knuckles slightly observed as dots | 100 |
| Example 7 | 1.10 | Fair; undulations of knuckles slightly observed as dots | 175 |
| Example 8 | 1.15 | Fair; undulations of knuckles slightly observed as dots | 75 |
| Example 9 | 1.15 | Fair; undulations of knuckles slightly observed as dots | 125 |
| Comparative Example 1 | 1.30 | Failure; undulations of knuckles observed as dots | 300 or more |
| Comparative Example 2 | 1.10 | Failure; undulations of knuckles observed as dots | 300 or more |

As is shown in the table, Examples of the felt of the present invention match Comparative Examples in resistance to flattening, and are superior to them in surface smoothness of a wet paper web and anti-dehairing property.

INDUSTRIAL APPLICABILITY

The present invention provides a papermaking felt which is capable to improve surface smoothness of a wet paper web and has improved anti-dehairing property while keeping resistance to flattening intact. When used as a papermaking felt, the felt is capable of sustaining resistance to flattening against compression by a roll or a shoe press in a papermaking process, and therefore capable of maintaining a high dewatering capability over a long term. Further, this invention provides a felt with enhanced performance which is capable to improve surface smoothness of a wet paper web and has improved anti-dehairing property and which is usable for high-speed papermaking machines or under high pressure in a press section.

What is claimed is:

1. A papermaking felt having a wet paper web side and a machine side, wherein a staple fiber web is layered on one side or both sides of a woven fabric of a base body, and wherein the web and base body are intertwiningly integrated by needling, characterized in that yarns of said woven fabric arranged on said wet paper web side of said base body extend both in the MD and CMD directions, and the yarns arranged on said wet paper web side that extend in at least one of the MD and CMD directions are multifilament yarns each composed of a bundle of a plurality of filaments having a twist in the range from 1 to 50 turns per meter, said yarns composed of a bundle of a plurality of filaments having a fineness of 100 dtex or less.

2. A papermaking felt as claimed in claim 1, characterized in that said base body comprises two or more woven fabrics of the same or different types.

3. A papermaking felt as claimed in claim 1, characterized in that said base body is made of a triple weave fabric.

4. A papermaking felt as claimed in claim 1, characterized in that said multifilament yarns are loosely twisted yarns having a twist in the range from 1-30 turns per meter.

5. A papermaking felt as claimed in claim 1, in which said multifilament yarns are single twist yarns.

* * * * *